US008634740B2

(12) United States Patent
Sakai

(10) Patent No.: US 8,634,740 B2
(45) Date of Patent: Jan. 21, 2014

(54) FIXING DEVICE AND IMAGE FORMATION DEVICE

(75) Inventor: Toshiyuki Sakai, Shinshiro (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 13/481,162

(22) Filed: May 25, 2012

(65) Prior Publication Data

US 2012/0308255 A1 Dec. 6, 2012

(30) Foreign Application Priority Data

May 31, 2011 (JP) ..... 2011-121593

(51) Int. Cl.
*G03G 15/20* (2006.01)
*H05B 11/00* (2006.01)

(52) U.S. Cl.
USPC ..... 399/90; 399/122; 399/329; 219/216

(58) Field of Classification Search
USPC ..... 399/67, 88, 90.122, 329; 219/216
See application file for complete search history.

(56) References Cited

U.S. PATENT DOCUMENTS

| | | | | |
|---|---|---|---|---|
| 8,165,485 | B2 * | 4/2012 | Asakura et al. | 399/69 |
| 2010/0086324 | A1 | 4/2010 | Smith | |
| 2011/0222932 | A1 * | 9/2011 | Hayase et al. | 399/329 |
| 2011/0293340 | A1 | 12/2011 | Yamamoto et al. | |
| 2012/0027480 | A1 * | 2/2012 | Hara | 399/333 |
| 2012/0155912 | A1 * | 6/2012 | Hayase et al. | 399/90 |

FOREIGN PATENT DOCUMENTS

| | | |
|---|---|---|
| JP | 9-16013 | 1/1997 |
| JP | 9-34295 | 2/1997 |
| JP | 2009-109997 | 5/2009 |
| JP | 2011-248264 | 12/2011 |

OTHER PUBLICATIONS

Decision to Grant a Patent mailed Aug. 20, 2013, directed to JP Application No. 2011-121593; 3 pages.

* cited by examiner

*Primary Examiner* — David Gray
*Assistant Examiner* — Francis Gray
(74) *Attorney, Agent, or Firm* — Morrison & Foerster LLP

(57) ABSTRACT

A fixing device includes an endless belt with a resistance heating layer, a pressure roller fitting loosely in a belt circulation path, and a pressing roller pressing the pressure roller through the belt to form a fixing nip with a belt surface, and thermally fixes an unfixed image by passing a recording sheet through the fixing nip, comprises: a pair of annular electrodes provided circumferentially and sandwiching a sheet-passing region of the belt surface; a first power supply member pressurizing a given one of the electrodes; and a second power supply member positioned closer to the fixing nip than the first power supply member, also pressurizing the given one of the electrodes, and supplying power to the resistance heating layer in cooperation with the first power supply member, wherein the pressing force applied by the first power supply member is weaker than that applied by the second power supply member.

7 Claims, 8 Drawing Sheets

FIXING DEVICE AND IMAGE FORMATION DEVICE

This application is based on an application No. 2011-121593 filed in Japan, the contents of which are hereby incorporated by reference.

BACKGROUND OF THE INVENTION (1) Field of the Invention

The present invention pertains to a fixing device and an image formation device using the fixing device, specifically to a fixing device including a resistance heating layer.

(2) Description of the Related Art

In recent years, greater energy economy than that offered by halogen heaters has been sought for the fixing devices used in image formation devices, such as printers. Propositions include the use of a fixing device having a fixing belt that includes a resistance heating layer (e.g., Japanese Patent Application Publication No. 2009-109997).

FIG. 7 is an overall perspective view diagram of such a fixing device 500.

As shown, the fixing device 500 includes a fixing belt 554, a pressure roller 550, a pressing roller 560, and a pair of power supply rollers 570 connected to an A/C power supply.

The fixing belt 554 is a cylindrical, resilient, and deformable belt that includes a resistance heating layer 554*b* and has electrodes 554*e* formed over the resistance heating layer 554*b* at each end thereof, in the width (Y-axial) direction.

The pressure roller 550 has a metal core 551 covered by a resilient layer 552, and the fixing belt 554 is loosely fit therearound so as to circulate.

A pressing roller 560 is arranged outside the circulation path of the fixing belt 554 and pressurizes the pressure roller 550 through the fixing belt 554, forming a fixing nip 530.

Also, the pressing roller 560 receives a driving force from a (non-diagrammed) driving motor and thus rotates in the direction indicated by arrow P. The driving force is transmitted through the fixing belt 554 to the pressure roller 550, such that the fixing belt 554 and the pressure roller 550 are driven to rotate in the direction indicated by arrow Q.

The pair of power supply rollers 570 is in contact with the electrodes 554*e* of the fixing belt 554, outside the circulation path, pressing the fixing belt 554 downward, as shown (i.e., in the Z' direction). Accordingly, power is supplied to the resistance heating layer 554*b* of the fixing belt 554.

According to this configuration, the electrodes 554*e* supply power via the power supply roller 570 while the fixing belt 554 is driven to circulate. As this occurs, the electrical resistance in the electrodes 554*e* is much less than that of the resistance heating layer 554*b*, to the extent that voltage drops in the electrodes 554*e* are safely ignored. Thus, electrical current flows over the entire circumference of each electrode 554*e* and Y-axially across the entire resistance heating layer 554*b*, producing heat therein.

Given that the direction of the current I periodically reverses, the direction indicated in FIG. 7 for the current I is simply an example at a given point in time.

Here, portions of the fixing belt 554 other than those pressed by the fixing nip 530 and the power supply roller 570 are not in contact with any other components and cannot avoid surrounding heat. As such, temperatures effectively increase in the region of the fixing nip 530 through Joule heating and, when a (non-diagrammed) recording sheet with a toner image formed thereon passes through the fixing nip 530, the heat and pressure fixes the toner image to the recording sheet.

However, when the pressing roller 560 is driven to rotate while being pressed by the pressure roller 550 through the fixing belt 554, the friction between the power supply roller 570 and the fixing belt 554, which is deformed into an oval, leads to unstable running conditions for the fixing belt 554 and may cause running path fluctuations (hereinafter, ripples) in slack portions occurring in the fixing belt 554.

FIGS. 8A and 8B illustrate a somewhat exaggerated aspect of the ripple phenomenon occurring on the fixing belt 554.

As shown in FIG. 8A, the power supply roller 570 is normally pressed toward the pressure roller 550 by a compressed spring 571 or similar. When a rise portion 554*a* forms in the slack portion, having risen away from the pressure roller 550, regains its original position upon passing through, and the motion of the fixing belt 554 follows with some delay, then as shown in FIG. 8B, a space S may be produced between the power supply roller 570 and the fixing belt 554.

As such, the potential difference between the power supply roller 570 and the fixing belt 554 produces a spark across the space S, which is problematic in that a small hole may be opened thereby in the surface of the fixing belt 554, reducing the useful life thereof.

SUMMARY OF THE INVENTION

In consideration of this problem, the present invention pertains to a fixing belt that includes a resistance heating layer and electrodes supplying electricity thereto in a fixing device, and an image formation device including the fixing belt circulating loosely around a pressure roller and heated by resistance heating, and aims to extend the useful life of the fixing belt.

In one aspect of the present invention, a fixing device includes an endless belt with a resistance heating layer, a pressure roller fitting loosely in a circulation path of the belt, and a pressing roller pressing the pressure roller through the belt to form a fixing nip in conjunction with a surface of the belt, and thermally fixes an unfixed image on a recording sheet by passing the recording sheet through the fixing nip, and comprises: a pair of annular electrodes provided circumferentially so as to sandwich a sheet-passing region on the surface of the belt therebetween; a first power supply member pressurizing a given one of the electrodes with pressing force; and a second power supply member positioned closer to the fixing nip than the first power supply member, pressurizing the given one of the electrodes with pressing force, and supplying power to the resistance heating layer in cooperation with the first power supply member, wherein the pressing force applied by the first power supply member is weaker than the pressing force applied by the second power supply member.

In another aspect of the present invention, an image formation device comprises a fixing device including an endless belt with a resistance heating layer, a pressure roller fitting loosely in a circulation path of the belt, and a pressing roller pressing the pressure roller through the belt to form a fixing nip in conjunction with a surface of the belt, and thermally fixes an unfixed image on a recording sheet by passing the recording sheet through the fixing nip, the fixing device comprising: a pair of annular electrodes provided circumferentially so as to sandwich a sheet-passing region on the surface of the belt therebetween; a first power supply member pressurizing a given one of the electrodes with pressing force; and a second power supply member positioned closer to the fixing nip than the first power supply member, pressurizing the given one of the electrodes with pressing force, and supplying power to the resistance heating layer in cooperation with the first power supply member, wherein the pressing force applied by the first power supply member is weaker than the pressing force applied by the second power supply member.

BRIEF DESCRIPTION OF THE DRAWINGS

These and the other objects, advantages and features of the invention will become apparent from the following description thereof, taken in conjunction with the accompanying drawings which illustrate a specific embodiment of the invention.

In the drawings.

DESCRIPTION OF THE PREFERRED EMBODIMENTS

A fixing device and an image formation device pertaining to the present invention are described below, with reference to the accompanying drawings.

(Image Formation Device Configuration)

Figure 1:
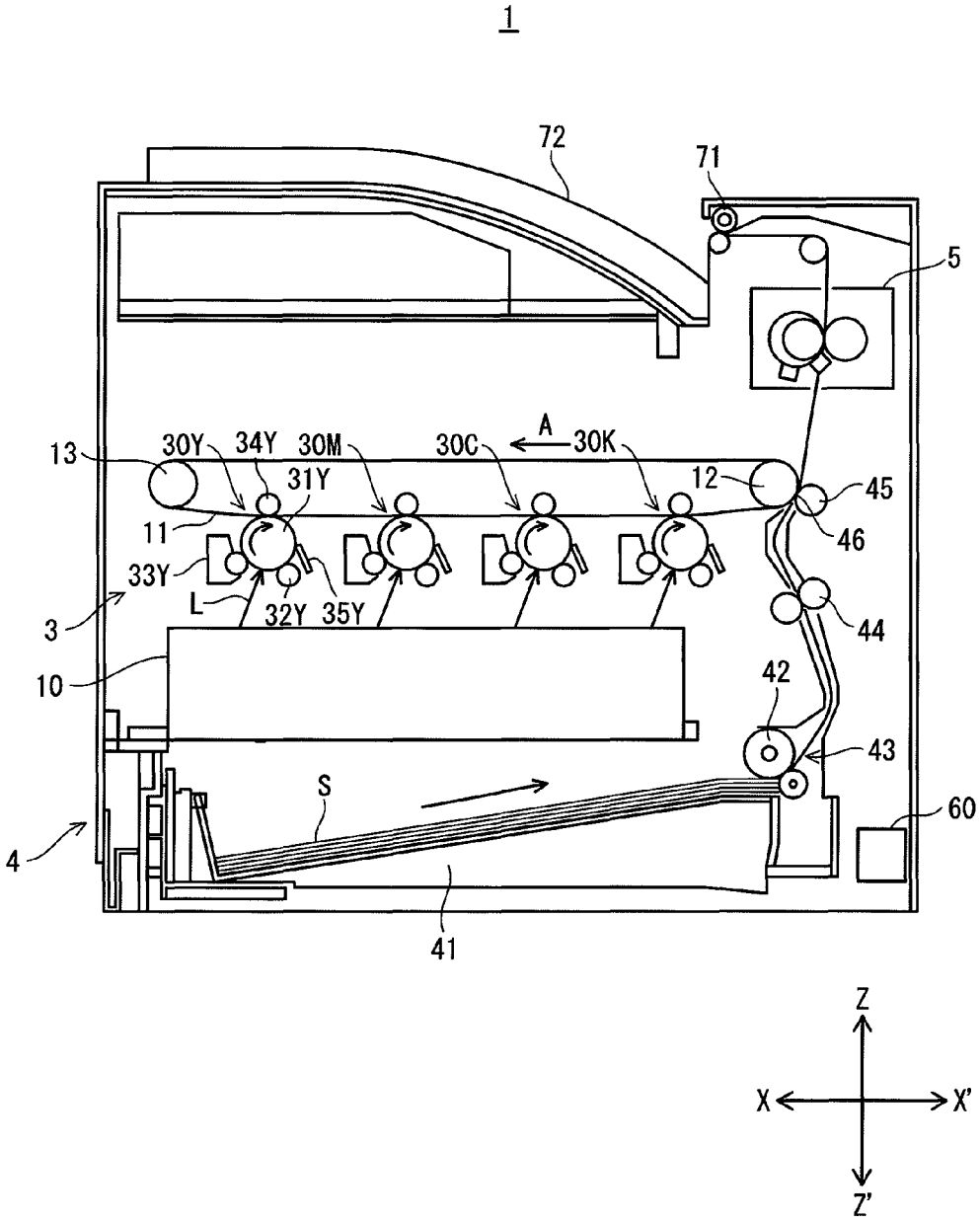
FIG. 1 is an overall diagram illustrating a tandem color printer serving as an example of an image formation device including a fixing device pertaining to an Embodiment of the present invention.

FIG. 1 is an overall configuration diagram illustrating a tandem colour printer (hereinafter, printer) serving as an example of an image formation device that includes a fixing device pertaining to the Embodiment of the present invention.

As shown, the printer 1 includes an image processing unit 3, a feed unit 4, a fixing unit 5, and a control unit 60. The printer 1 is connected to a network (e.g., a LAN), receives a print job execution instruction from a (non-diagrammed) external terminal, forms a toner image corresponding to the received instruction in each of yellow, magenta, cyan, and black, then creates a full-colour image through overlay transfer of these images.

The colours yellow, magenta, cyan, and black are hereinafter respectively abbreviated Y, M, C, and K. Components pertaining to reproduction of a given colour are marked with Y, M, C, or K as appropriate.

(Image Processing Unit)

The processing unit 3 includes imaging units 30Y, 30M, 30C, and 30K each corresponding to a colour Y, M, C, or K, an optics unit 10, and an intermediate transfer belt 11.

Imaging unit 30Y includes a photosensitive drum 31Y, a charger 32Y, a developer 33Y, a primary transfer roller 34Y, and a cleaner 35Y for cleaning the photosensitive drum 31Y, all disposed at the periphery thereof. A yellow toner image is created on the photosensitive drum 31Y.

The other imaging units 30M, 30C, and 30K are configured similarly to imaging unit 30Y. The reference signs therefor are thus omitted from FIG. 1.

The intermediate transfer belt 11 is an endless belt overspanning a driving roller 12 and a driven roller 13 and driven to rotate in the direction indicated by arrow A.

The optics unit 10 includes a light-emitting element, which is a laser diode and so on. The optics unit 10 produces laser light L for forming the image in the colours Y, M, C, K in accordance with a drive signal from the control unit 60 by scanning the photosensitive drums 31Y, 31M, 31C, and 31K.

Exposure to the laser light L causes each of the photosensitive drums 31Y, 31M, 31C, 31K, charged by the corresponding charger 32Y, 31M, 31C, or 32K, to form a latent static image. Each latent static image is formed by performing a primary transfer of the Y, M, C, K-colored toner images developed on the photosensitive drums 31Y, 31M, 31C, and 31K by the developers 33Y, 33M, 33C, and 33K onto the intermediate transfer belt 11, the transfer timed so as to overlap at a common position.

A full-color toner image is formed by sequential transfer of the toner images on the intermediate transfer belt 11, operated by the primary transfer rollers 34Y, 34M, 34C, and 34K through the action of static electricity. The full-color toner image is then shifted toward a secondary transfer position 46.

The feed unit 4 includes a paper feed cassette 41 containing recording sheets, a pick-up roller 42 picking up the recording sheets in the paper feed cassette 41 one by one for passage into a transport path 43, and a pair of timing rollers 44 for adjusting the timing at which each recording sheet is sent to the secondary transfer position 46. A recording sheet is fed to the secondary transfer position from the feed unit 4 at timing matching that of the toner image transfer on the intermediate transfer belt 11, and the toner images undergo a secondary transfer as a batch, through the action of a secondary transfer roller 45.

Having passed through the secondary transfer position 46, the recording sheet is transported to the fixing unit 5. The (unfixed) toner image on the recording sheet is heated and pressurized by the fixing unit 5, thus becoming fixed in place. Afterward, the recording sheet is taken to an exit tray 72 by the action of a pair of exit rollers 71.

(Fixing Unit Configuration)

Figure 2:
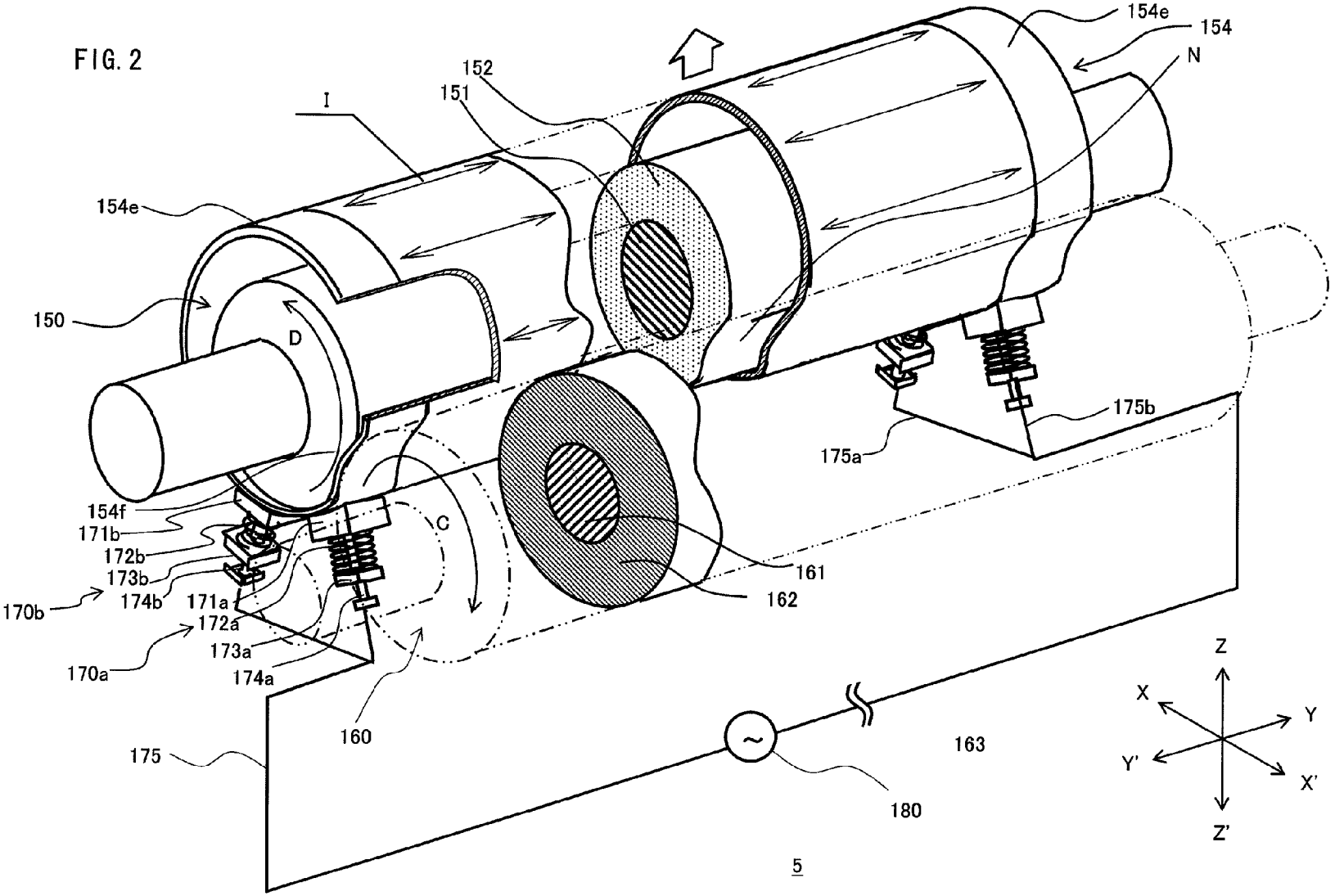
FIG. 2 is a partial cutaway perspective view diagram of the fixing device.

FIG. 2 is a partial cross-section of the aforementioned fixing unit 5.

As shown, the fixing unit 5 includes a fixing belt 154, a pressure roller 150, a pressing roller 160, and power supply members 170*a* and 170*b*.

The pressure roller 150 is arranged loosely inside the fixing belt 154 so as to be parallel to the pressing roller 160. A fixing nip N is formed between the fixing belt 154 and the pressing roller 160 through bias applied to the pressing roller 160 by a non-diagrammed biasing mechanism toward the pressure roller 150 through the fixing belt 154. The toner image formed on the (non-diagramed) recording sheet is heated and pressurized by passing through the fixing nip N.

The components of the fixing unit 5 are described in detail, below.

(Pressing Roller Configuration)

The pressure roller 150 is driven by a non-diagrammed drive mechanism to rotate in the direction indicated by arrow C. The pressure roller 150 applies pressure to the fixing belt 154 from the outside.

Accordingly, the fixing belt 154 and the pressure roller 150 are driven to rotate in the direction indicated by arrow D.

As shown in FIG. 2, the pressing roller 160 includes a metal core 161 covered by resilient layer 162, everywhere but the two ends thereof.

The metal core 161 is a solid shaft made of a metal such as aluminum, steel, or stainless steel, 30 mm in diameter, driven to rotate by the non-diagrammed drive mechanism.

The solid shaft may be replaced with a hollow shaft of a thickness ranging from 0.1 mm to 10 mm, inclusive, or with a hollow shaft having a support rib with a Y-shaped cross-section installed therein.

Resilient layer 162 is a tube made of silicone rubber, having a thickness that is ideally between 1 mm and 20 mm, inclusive.

In the present Embodiment, the thickness of resilient layer 162 is 3 mm, and the outer diameter thereof is 36 mm.

Resilient layer 162 is 374 mm long as measured along the Y-axis.

(Pressure Roller)

As shown in FIG. 2, the pressure roller 150 is made of a metal core 151 shaped as an elongated cylinder and enveloped by resilient layer 152.

The metal core 151 is a solid shaft made of a metal such as aluminum, steel, or stainless steel, 20 mm in diameter. The two axial ends of the shaft are supported by non-diagrammed bearings in the frame of the fixing unit 5 so as to be able to rotate freely.

The solid shaft may be replaced with a hollow shaft of a thickness ranging from 0.1 mm to 10 mm, inclusive, or with a hollow shaft having a support rib with a Y-shaped cross-section installed therein.

Resilient layer 152 is made of a heat-resistant, adiabatic material, such as a resilient foam of silicone rubber or fluorine rubber, having a thickness of 1 mm to 20 mm. Accordingly, the outer diameter of the pressure roller 150 is between 20 mm and 100 mm, inclusive. In the present Embodiment, the outer diameter is 30 mm.

Resilient layer 152 is 374 mm long as measured along the Y-axis.

The length of resilient layer 152, as measured along the Y-axis, should of course be longer than the maximum passing width of a recording sheet.

Resilient layer 152 is less film than resilient layer 162 of the pressing roller 160. The nip N is formed primarily by elastic deformation of resilient layer 152.

(Fixing Belt)

Figure 3:
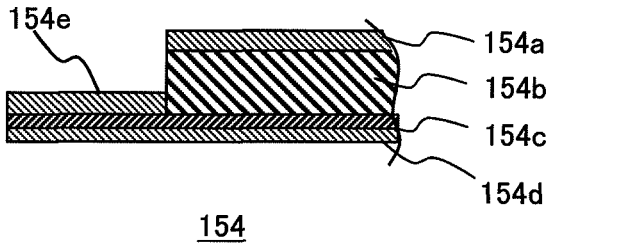
FIG. 3 is a partial cross-section of a fixing belt in the fixing device.
Figure 3:
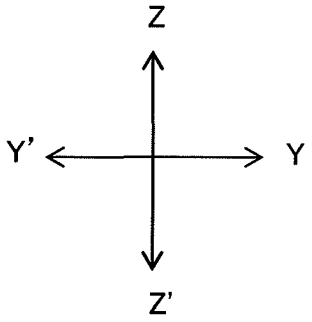

FIG. 3 is a partial cross section indicating the layer structure of the fixing belt 51.

The fixing belt 51 is illustrated in FIG. 3 with particular attention to one end in the roller-axial direction. The other end of the fixing belt 51 is configured identically.

Also, in FIG. 3, the thickness is greatly exaggerated for ease of comprehension. The dimensions of each component are given as examples and do not necessarily correspond to those of actual components.

The fixing belt 154 is an endless, elastically-deformable belt having a layered structure. As shown, a resistance heating layer 154*b* is layered over the outer circumferential surface of an insulating layer 154*a*. Further, an electrode layer 154*e* is layered on each of the Y-axial ends of the resistance heating layer 154*b*.

Furthermore, resilient layer 154*c* and a release layer 154*d* are sequentially layered over areas the resistance heating layer 154*b* not covered by the electrode layer 154*e*.

The components of the fixing belt 154 are described in detail, below.

The insulating layer 154*a* is made of a material that does not conduct electricity, such as PI (polyimide), PPS (polyphenylene sulfide), PEEK (polyether ether ketone), having a thickness of approximately 50 μm and a length of 374 mm along the Y axis.

The resistance heating layer 154*b* is a heat-producing tube that undergoes Joule heating as a result of electric current producing differences in electric potential between the Y-axial ends.

Specifically, the resistance heating layer 154*b* has a thickness of 5 mm to 200 mm inclusive and is made of a PI resin having one or more varieties of conductive filler dispersed throughout, each variety having a different electrical resistance.

The Y-axial length of the resistance heating layer 154*b* is 374 mm, similar to that of the insulating layer 154*a*.

The material used for the base of resistance heating layer 154*b* (hereinafter, base material) may also be PPS or PEEK.

The different varieties of conductive filler may be a powdered metal, such as silver, copper, aluminum, magnesium, or nickel, a powdered carbon compound, such as graphite, carbon black, carbon nanofibers, or carbon nanotubes, or may be an inorganic compound that is also a fast ion conductor, such as silver iodide or copper iodide. The conductive filler is preferably shaped as fibers so as to increase the probability of contact at the unit content level.

In the present Embodiment, the fibrous conductive filler is, for example, nickel scattered uniformly throughout the above-described base material.

The volume resistivity of the resistance heating layer 154*b* is preferably on the order of $10\times10^{-6}$ Ω·m to $1.0\times10^{-2}$ Ω·m, inclusive, and for the fixing unit 5 pertaining to the present Embodiment, is ideally between $10\times10^{-5}$ Ω·m to $5.0\times10^{-3}$ Ω·m, inclusive.

Resilient layer 154*c* is, for example, made of a resilient and heat-resistant material such as silicone rubber and has a thickness of approximately 500 μm.

The material used for resilient layer 154*c* may alternatively be fluorine rubber or the like.

The release layer 154*d* is made, for example, of a fluorine-based resin such as PTFE or PFA, and has a thickness of 5 μm to 100 μm, inclusive.

The electrode layer 154*e* is formed as a loop so as to cover the Y-axial ends of the resistance heating layer 154*b*, and is provided as a pair of annular electrodes for supplying electricity to the resistance heating layer 154*b*.

The electrode layer 154*e* is, for example, formed of a metal having lower electrical resistivity than the resistance heating layer 154*b*, such as copper, aluminum, nickel, brass, or phosphor bronze, and may be formed over the ends of the resistance heating layer 154*b* through chemical plating, electroplating, or the like.

Alternately, a strip from a sheet of any of the above materials may be applied to the Y-axial ends of the resistance heating layer 154*b* by means of a conductive adhesive, thus forming the electrode layer 154*e*.

The width (Y-axial length) of the electrode layer 154*e* is 18 mm.

Further, the thickness of the electrode layer 154*e* is preferably between 5 μm and 100 μm, inclusive, so as to preserve the flexibility needed to deform the belt, particularly when forming the fixing nip N, while providing appropriate rigidity. In this example, the electrode layer 154*e* is 20 μm thick.

(Power Supply Member)

Again, as shown in FIG. 2, the power supply members 170*a* and 170*b* are provided as a pair on each of two pieces of the electrode layer 154*e* on the below-described fixing belt 154.

Specifically, the power supply members 170*a* and 170*b* are electrically connected to an external A/C power supply 180 through respective lead wires 175*a* and 175*b* and press against the electrode layer pieces, thus supplying power thereto.

Power supply member 170*a* presses against a piece of the electrode layer 154*e* at a position closer to the fixing nip N than power supply member 170*b*.

Accordingly, two power supply members press against the pieces of the electrode layer 154*e* and supply power thereto. This enables power to be supplied in a more stable and reliable manner.

The lead wires 175*a* and 175*b* branch off from a common lead wire (hereinafter, main lead unit) 175. The main lead unit 175 is connected to the A/C power supply 180 via a non-diagrammed relay switch.

The control unit 60 switches the relay switch ON or OFF in accordance with the surface temperature of the fixing belt 154, read by a non-diagrammed temperature sensor, thus maintaining a target temperature for the fixing belt 154.

Power supply member 170*a* includes a brush unit 171*a*, a flexible member 172*a*, a support plate 173*a*, and a shaft unit 174*a*.

Similarly, power supply member 170*b* includes a brush unit 171*b*, a flexible member 172*b*, a support plate 173*b*, and a shaft unit 174*b*. All components other than flexible member 172*b* are identical to those of power supply member 170*a*.

The brush unit 171*a* is, for example, a block-like conductor having a thickness of 30 mm, a Y-axial width of 10 mm, and a length of 5 mm along a sliding-motion direction thereof. The brush unit 171*a* is a carbon brush made of a slidable, conductive material such as copper graphite or carbon graphite.

The current density may grow to excess and produce undesirable holes in the electrode layer 154*e* not only when, for example, spark discharge occurs between the pieces of the electrode layer 154*e* and the power supply members 170*a* and 170*b*, but also when, for example, the contact surface therebetween temporarily becomes excessively small and causes a locally-concentrated current density to occur.

As described above, the block-like brush unit 171*a* is pressed by the piece of the electrode layer 154*e*, thus securing a wider area for surface contact such that the probability of temporarily reducing the surface contact area to an extremely small size is reduced, even under unstable connection conditions.

The shaft unit 174*a* is a conductive shaft made of metal or similar, fixedly incorporated into the brush unit 171*a* at one end and connected to the lead wire 175*a* at the other end.

The support plate 173*a* is joined to the main frame of the fixing unit shaft unit, and has a (non-diagrammed) through-hole through which the shaft unit 174*a* passes so as to be freely slideable.

The flexible member 172*a* is, for example, a compression spring interposed between the brush unit 171*a* and the support plate 173*a*. As shown in FIG. 2, the brush unit 171*a* presses against the outer circumferential surface of the piece of the electrode layer 154*e*.

Here, pressing force F1 is given as follows, in Newtons.

$$F1=Fs+Fc \quad \text{(Math. 1)}$$

where Fs is the pressing force securable for stable electricity application while the fixing belt is stopped, given in Newtons, and Fc is maximum force pulling the brush unit 171*a* away from the fixing belt toward the normal direction of the contact surface through ripple phenomena occurring on the fixing belt during circulation, also given in Newtons.

The value of Fs must be on the order of 0.2 N to 0.5 N, as determined experimentally.

When the value of Fs falls below the above-described range for pressing force, the contact resistance increases, producing heat at the contact portion between the brush unit 171*a* and the piece of the electrode layer 154*e* and decreasing the efficacy of the power supply.

Given that influential elements such as the position at which force is applied by the power supply member 170*b* to the fixing belt 154 and the value of pressing force F2 are prone to fluctuations, the value of Fc is determined experimentally upon investigation of these elements.

This is because the ripple phenomenon occurring on the fixing belt 154 is likely to occur at a position farther from the fixing nip N (hereinafter, nip-distal portion) at greater separation from the pressure roller 150. The ripple phenomenon produced at the nip-distal portion is then likely to propagate to the vicinity of the fixing nip N (hereinafter, nip-proximal portion).

Therefore, the inventor has mainly set the value of pressing force F1 on the electrode layer 154*e* so as to provide reliable electricity supply from the power supply member 170*a* provided at the nip-proximal portion, where the ripple phenomenon is less likely to occur. Consequently, the value of pressing force F2 for the power supply member 170*b* provided at the nip-distal portion, where the ripple phenomenon is more likely to occur, is sufficient when set high enough to constrain ripple propagation from the nip-distal portion to the nip-proximal portion.

Accordingly, pressing force F2 is set to be smaller than pressing force F1, satisfying the following.

$$F2<F1 \quad \text{(Math. 2)}$$

That is, in contrast to conventional technology where only one power supply member is provided for each electrode, the present Embodiment features two power supply members for the fixing unit 5. Thus, there is no need to apply the double pressing force required in conventional technology when only one power supply member is present.

As a result, the load on the motor driving the pressing roller 160 is reduced, the abrasion of the pieces of the electrode layer 154*e* is mitigated, and the abrasive deterioration of the fixing belt 154 is correspondingly decreased.

As described above, the fixing unit 5 pertaining to the present Embodiment has at least one member of a pair of annular pieces of the electrode layer 154*e* pressurized by power supply member 170*b* and power supply member 170*a*, which is located closer to the fixing nip, both supplying electrical power thereto. The pressing force of power supply member 170*a* is weaker than that of power supply member 170*b*.

The ripple phenomenon occurring on the fixing belt 154 is more likely to occur at positions farther from the nip portion. Thus, the pressing force of power supply member 170*b* serves to reduce the amplitude of the ripple phenomenon, which places a constraint on the amplitude of the ripple phenomenon propagated as far as power supply member 170*a*, arranged closer to the nip portion than power supply member 170*b*. As such, power supply member 170*a* serves as the main power supply member and the reliability of contact between power supply member 170*a* and the piece of the electrode layer 154*e* can be improved. Therefore, the risk of spark discharge damaging the electrode layer 154*e* is diminished, promoting a longer useful life for the fixing belt 154.

Here, power supply member 170*b* need only press the belt with force sufficient to constrain the propagation of the ripple phenomenon, and does not require as much pressing force as power supply member 170*a*. Thus, the pressing force of power supply member 170*b* may be weaker than that of power supply member 170*a*. As described above, this enables reduction of the abrasion imposed on the electrode layer 154*e* by power supply member 170*a*.

Also, both power supply members 170*a* and 170*b* are in contact with a single piece of the electrode layer 154*e*. Thus, the total contact surface area between the electrode layer 154*e* and the power supply members is increased in comparison to conventional technology. This leads to improved stability for the power supply and reduced likelihood of spark discharge, in turn extending the useful life of the belt.

Also, the inventor has arranged the position at which the power supply member 170*b* presses the piece of the electrode layer 154*e* to be far from the fixing nip N so as to constrain ripple propagation, and therefore set the position of the power supply member 170*b* as described below.

When the pressure roller 150 is viewed along the length of the rotational axis, four regions are defined by line L1 passing through center O1 of the pressure roller 150 and center O2 of the pressing roller 160, and by line L2 passing through center O1 of the pressure roller 150 perpendicular to line L1. Of these, region R1 includes upstream edge P1 of the sheet-passing portion of the fixing nip N, region R2 includes downstream edge P2 of the sheet-passing portion of the fixing nip N, and the remaining regions R3 and R4 are so numbered in counterclockwise sequential order. At least one portion of the contact surface between power supply member 170*b* and the fixing belt 154 is positioned within region R1 or region R2, while power supply member 170*a* is positioned closer to the fixing nip N than power supply member 170*b*.

In the fixing unit 5 of the present Embodiment, at least portion A1 of the contact surface between power supply member 170*b* and the fixing belt 154 is positioned within region R1.

The following describes the reasoning behind this positioning of power supply member 170*b*.

Figure 5:
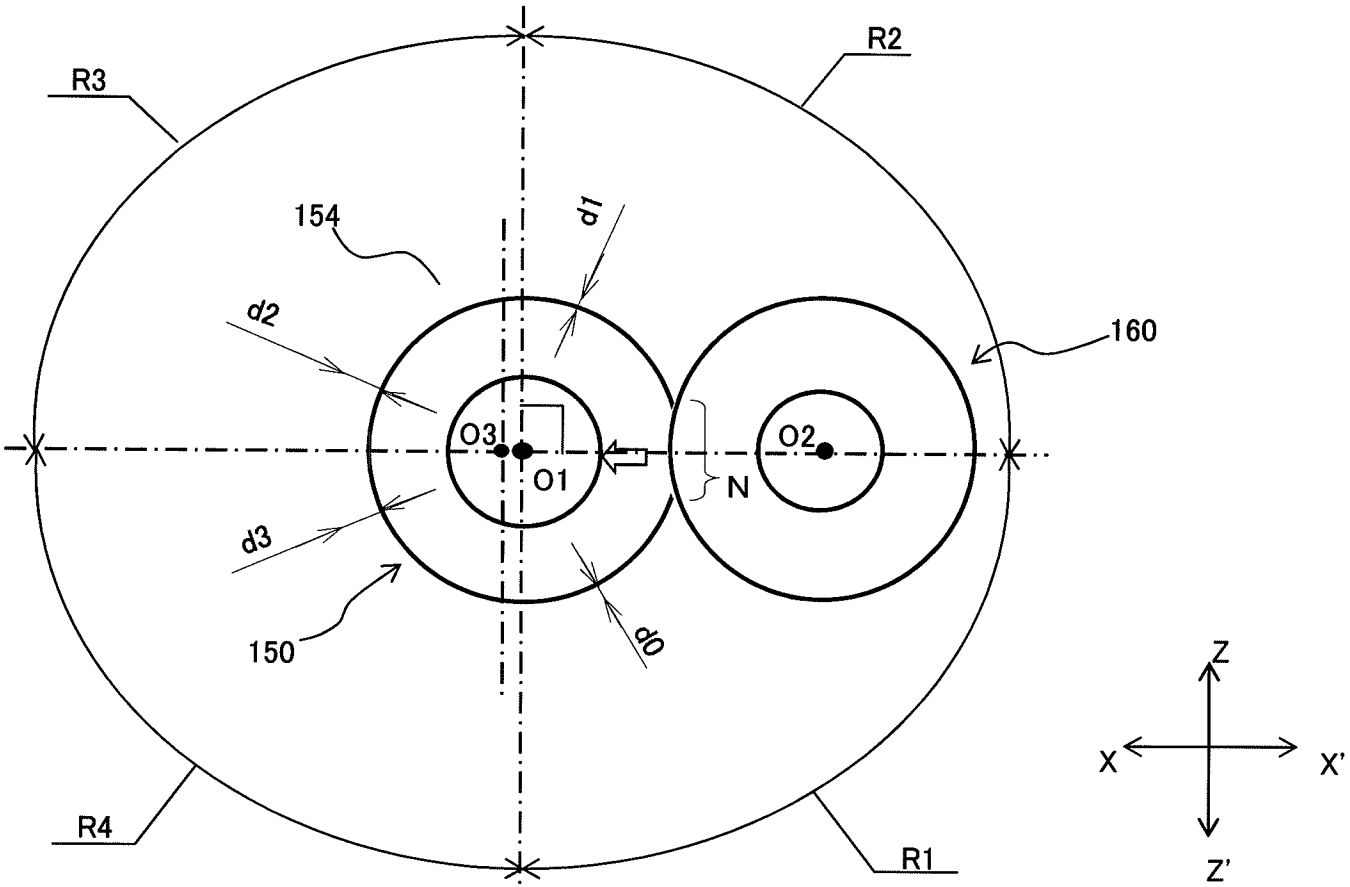
FIG. 5 illustrates the shape of the fixing belt in the fixing device when two power supply members that press electrodes are completely removed.

FIG. 5 illustrates the fixing unit 5 with power supply members 170*a* and 170*b*, which press the same piece of the electrode layer 154*e*, removed from the fixing belt 154.

Given that the pressing roller 160 presses the surface of the sheet leftward in the fixing nip N, center O3 of the fixing belt 154 is offset leftward with respect to center O1 of the pressure roller 150.

As such, gap d0 between the fixing belt 154 and the pressure roller 150 in region R1 is narrower than otherwise similar gap d1 in region R2. The positions thereof change very little, the fixing nip N notwithstanding.

Accordingly, when the power supply member 170*b* presses the piece of the electrode layer 154*e* in regions R1 and R2, the fixing belt 154 comes into contact with the pressure roller 150 and thus, ripples can be constrained without excessive pressing force F2.

However, in regions R3 and R4, gaps d2 and d3 between the fixing belt 154 and the pressure roller 150 widen with increasing distance from the fixing nip. Thus, in regions R3 and R4, when the piece of the electrode layer 154*e* is pressed by the power supply member 170*b*, a greater pressing force F2 is required to bring the fixing belt 154 and the pressure roller 150 into contact. As such, these areas are poor choices for the suppression of ripple propagation.

Thus, inventor has concluded that in order to suppress ripple propagation to the nip-proximal portion, at least part of the contact surface between the power supply member 170*b* and the fixing belt 154 should preferably be in region R1 or in region R2.

Of course, the power supply member 170*a* must be positioned in the same region as power supply member 170*b* and closer to the fixing nip N than the power supply member 170*b*.

In fact, Math. 1 and Math. 2 may be satisfied with experimentally obtained minimal values of Fc and F2, found by having the fixing belt 154 be driven to circulate, having the piece of the electrode layer 154*e* be pressed by the entire contact surface of power supply member 170*a* and by at least one portion of power supply member 170*b* in regions R1 and R2, and moving the pressing positions of the power supply members.

Power supply member 170*a* is positioned as close as possible to the fixing nip N, where the fixing belt 154 ripple phenomenon is less likely to occur, and preferably arranged as not to cause interference with the pressing roller 160.

Also, positioning the power supply members 170*a* and 170*b* in region R1 rather than in region R2 is preferable for securing a stable power supply.

This is because, in region R1, tensile force on the fixing belt 154 is produced between power supply member 170*b* and power supply member 170*a* as well as between power supply member 170*a* and the fixing nip N, making the fixing belt 154 less flexible. In contrast, in region R2, the fixing belt 154 experiences pressing-out due to the fixing nip N. Thus, the fixing belt 154 is easily flexible between the fixing nip N and power supply member 170*a*, which renders the contact surface between the fixing belt 154 and power supply member 170*a* unstable. Thus, pressing force F1 must be made larger.

(Variations)

The present invention is not limited to the above-described Embodiment. The following variations are also possible.

(1) In the above-described Embodiment, the power supply members 170*a* and 170*b* independently pressurize the piece of the electrode layer 154*e*. However, no limitation is intended. The power supply members 170*a* and 170*b* may also be molded integrally.

Figure 6:
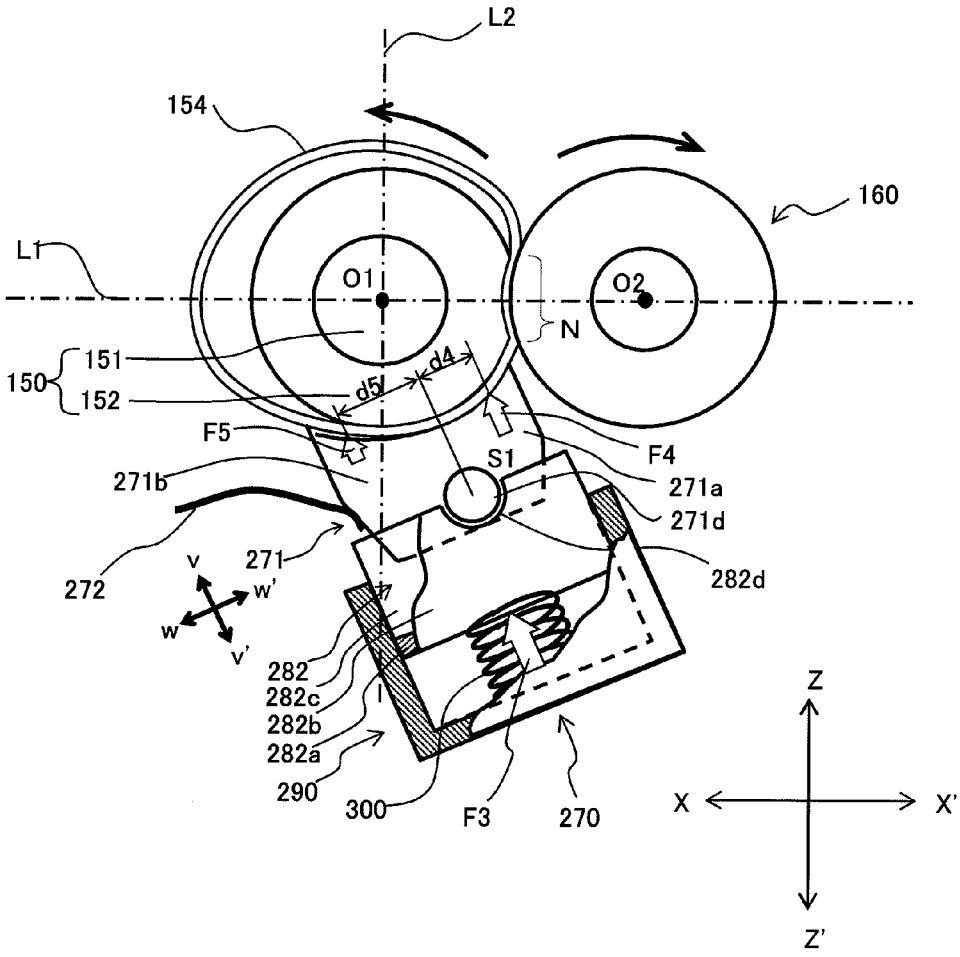
FIG. 6 illustrates a variant fixing device pertaining to the Embodiment.
Figure 7:
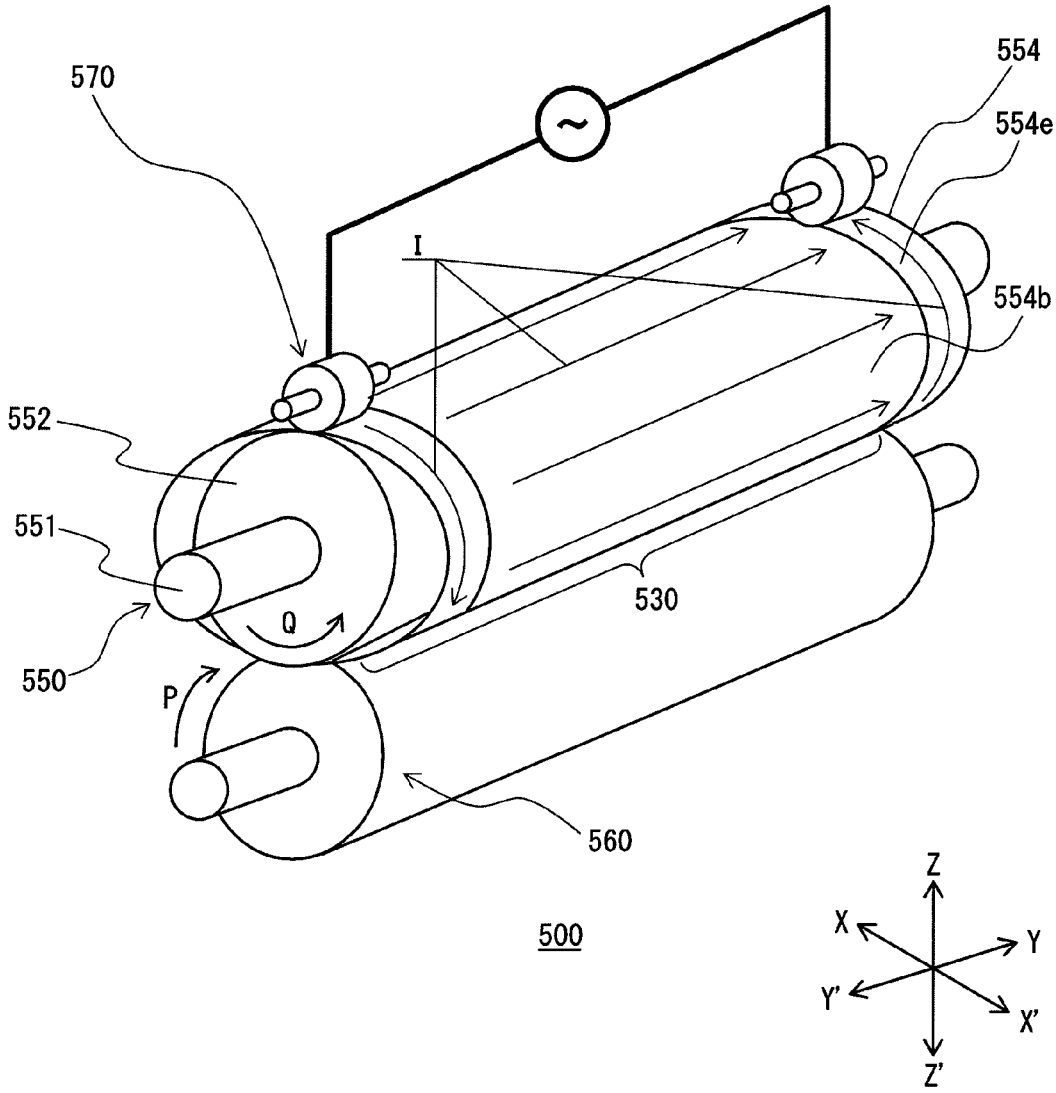
Prior Art FIG. 7
FIG. 7 is a perspective-view diagram of a fixing device in a conventional image formation device.
Figure 8A:
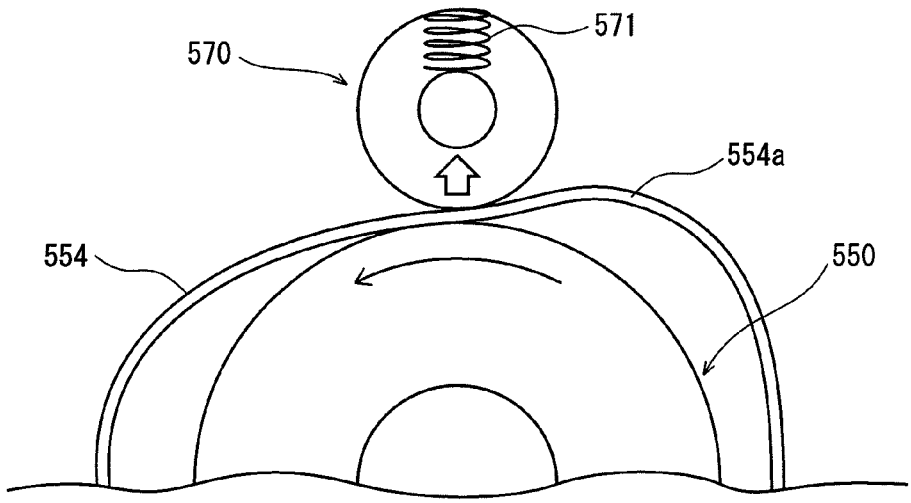
Prior Art FIG. 8A
FIGS. 8A and 8B illustrate a ripple phenomenon occurring in the fixing belt of the conventional fixing device.
Figure 8B:
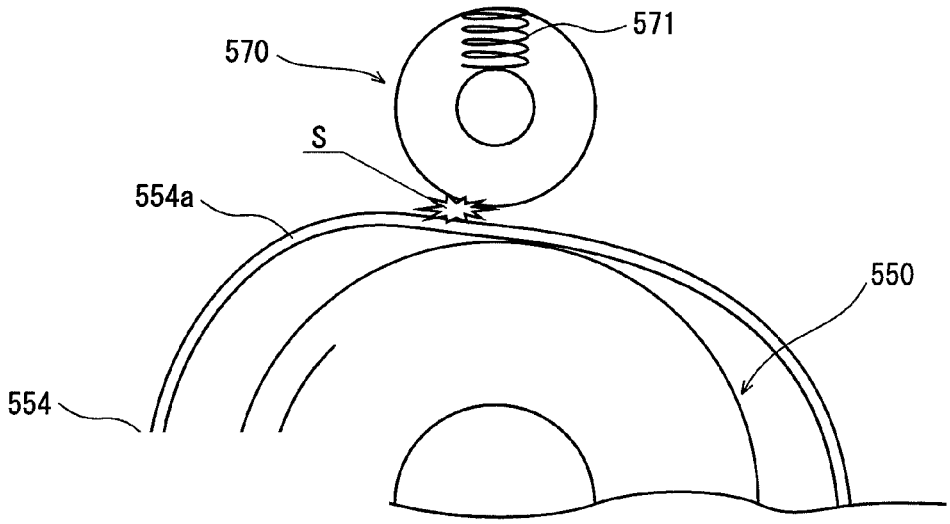
Prior Art FIG. 8B

FIG. 6 illustrates an example of such a configuration.

As shown, a power supply member 270 includes a brush unit 271, a support member 282, a guide member 290, and a compression member 300.

The support member 282, here shown as a partial cut-away, is U-shaped as seen in a cross-section taken along a plane that intersects the W axis. Side plates 282*b* and 282*c* are arranged to face each other on either side of the U-shape, and each have a semispherical notch 282*d*.

Figure 4:
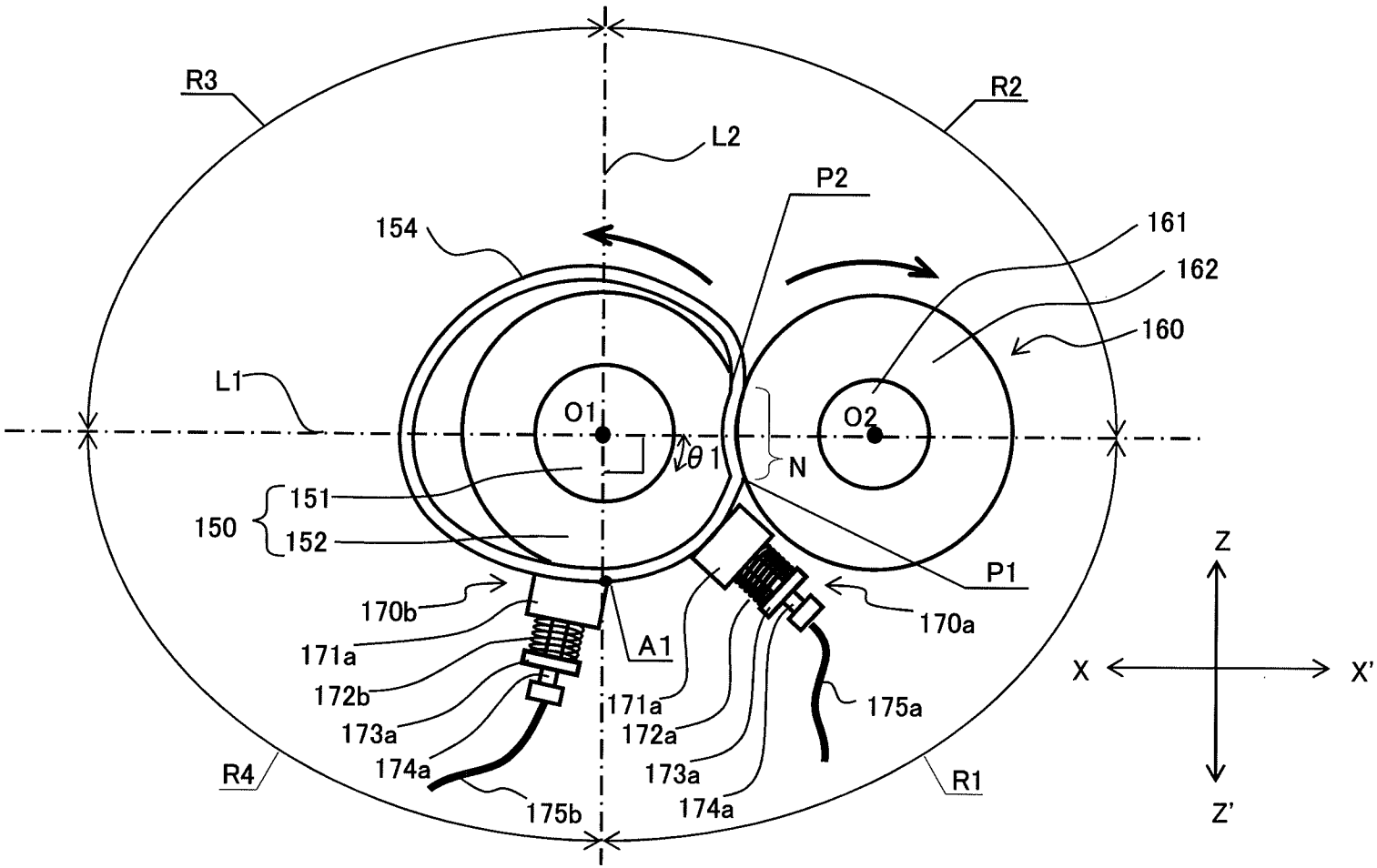
FIG. 4 is a side view diagram of the fixing device.

The brush unit 271 is also U-shaped, as seen along the axis of rotation of the pressure roller 150, and has arms 271*a* and 271*b* facing each other at either side of the U-shape. The aims 271*a* and 271*b* correspond to power supply members 170*a* and power supply member of the brush unit 171*a* shown in FIG. 4.

Further, the brush unit 271 has a support shaft 271*d* that is parallel to the axis of rotation of the pressure roller 150 and protrudes from the side plates at the front and back, as seen in FIG. 6. The support shaft 271*d* is supported in the notch 282*c* of the support member 282 so as to be freely rotatable.

As shown, the brush unit 271 is connected to a lead wire 272 for supplying power thereto.

The guide member 290 is a tubular body shaped to have a rectangular cross-section as taken in the plane intersecting the V axis of FIG. 6, and guides the support member 282 with respect to the V-axis.

The compression member 300 is a compression spring joined to the inner bottom surface of the guide member 290. When the support member 282 is inserted within the guide member 290, the support member 282 is biased along the V-axis by pressing force F3.

With respect to the W-axis orthogonal to the V-axis, the distances from the center of the support shaft 271*d* to the center of each arm 271*a* and 271*b*, respectively labeled distance d4 and distance d5, are such that d5 is longer than d4.

Therefore, pressing force F3 applied by the compression member 300 is divided along the arms 271*a* and 271*b* into pressing forces F4 and F5 such that pressing force F5 is smaller than pressing force F4.

Thus, the power supply member 270 serves the same functions as the individually provided power supply members 170*a* and 170*b*.

The configuration illustrated in FIG. 6 describes the brush unit 271 as provided in the support shaft 271*d*. However, no limitation is intended. A protrusion may be provided on one of the pair of side plates that face each other in the support member 282 and the brush unit 271 may have a recess provided to fit into this protrusion. Also, if needed, the support shaft 271*d* may be provided on any of these portions.

Further, FIG. 6 illustrates an example in which power supply members 170*a* and 170*b* form a common whole. However, a single conductive support member may also be used to support each of the power supply members 170*a* and 170*b*.

(2) In the above-described Embodiment, a single piece of the electrode layer 154*e* is pressurized by two power supply members. However, depending on circumstances, three or more power supply members may also be used for this purpose.

In such circumstances, the third and subsequent power supply members are provided at positions farther away from the fixing nip N than power supply member 170*b*. Also, the pressing force pressurizing the piece of the electrode layer 154*e* of the fixing belt 154 is set lower than or equal to the pressing force of the power supply member 170*b*. This is done in order to reduce the abrasive degradation of the fixing belt, following the same reasoning as that given for setting the pressing force of power supply member 170*b* to be weaker than that of power supply member 170*a*.

(3) In the above-described embodiment, the power supply members 170*a* and 170*b* are provided in pairs on each of a pair of pieces of the electrode layer 154*e*. However, depending on the circumstances, the power supply members 170*a* and 170*b* may be provided in a pair on only one piece of the electrode layer 154*e* while a single power supply member is provided on the other piece of the electrode layer 154*e*.

(4) In the above-described Embodiment, the fixing belt 154 includes the insulating layer 154*a*, the resistance heating layer 154*b*, the resilient layer 154*c*, the release layer 154*d*, and the electrode layer 154*e*. However, no limitation is intended, provided that the fixing belt 154 includes at least the resistance heating layer 154*b* and the electrode layer 154*e*.

For example, a monochrome copier does not require as wide a fixing nip, and fixing quality degradation is not as noticeable as in a color copier. Thus, the resilient layer 154*c* may be omitted from the fixing belt 154.

(5) In the above-described Embodiment, the brush unit 171*a* used in each power supply members 170*a* and 170*b* has the same shape. However, no limitation is intended. The shape and size of the brush unit may vary.

(6) In the above-described Embodiment, the pressing roller 160 drives the rotation and the pressure roller 150 is driven to rotate accordingly. However, no limitation is intended.

For example, the pressure roller 150 may drive the rotation while the pressing roller 160 is driven to rotate accordingly, or the pressure roller 150 and the pressing roller 160 may both drive the rotation.

(7) In the above-described Embodiment, resilient layer 152 of the pressure roller 150 is made less firm than resilient layer 162 of the pressing roller 160 so that the fixing nip N deformation occurs in resilient layer 152 of the pressure roller 150. However, no limitation is intended. In some circumstances, provided that the fixing quality does not deteriorate, the firmness of resilient layer 152 may be made greater than that of resilient layer 162, or the two resilient layers 152 and 162 may be equally firm.

(8) In the above-described Embodiments, the image formation device pertaining to the present invention is described using an example of a tandem color digital printer. However, the invention is also applicable to a monochrome printer or to any general image formation device that includes a fixing device having a resistance heating layer with an electrode layer supplying electricity thereto and having a fixing belt circulating loosely around a pressure roller and heated by resistance heating.

Further, the above-described Embodiment and variations may be freely combined.

Although the present invention has been fully described by way of examples with reference to the accompanying drawings, various changes and modifications will be apparent to those skilled in the art. Therefore, unless such changes and modifications depart from the scope of the present invention, they should be construed as being included therein.

What is claimed is:

1. A fixing device including an endless belt with a resistance heating layer, a pressure roller fitting loosely in a circulation path of the belt, and a pressing roller pressing the pressure roller through the belt to form a fixing nip in conjunction with a surface of the belt, and thermally fixing an unfixed image on a recording sheet by passing the recording sheet through the fixing nip, the fixing device comprising:

a pair of annular electrodes provided circumferentially so as to sandwich a sheet-passing region on the surface of the belt therebetween;

a first power supply member pressurizing a given one of the electrodes with pressing force; and a second power supply member positioned closer to the fixing nip than the first power supply member, pressurizing the given one of the electrodes with pressing force, and supplying power to the resistance heating layer in cooperation with the first power supply member, wherein the pressing force applied by the first power supply member is weaker than the pressing force applied by the second power supply member.

2. The fixing device of claim 1, wherein when the pressure roller is viewed along a rotational axis thereof, four regions are defined by a first line passing through a pressure roller centre and a pressing roller centre, and by a second line perpendicular to the first line passing through the pressure roller centre, a first region includes an upstream edge of the fixing nip, with respect to a sheet-passing direction, a second region includes a downstream edge of the fixing nip, with respect to the sheet-passing direction, and a contact surface area between the first power supply member and the belt is at least partly located within the first region or within the second region.

3. The fixing device of claim 2, wherein the contact surface area between the first power supply member and the belt is at least partly located within the first region.

4. The fixing device of claim 1, further comprising:

a support member supporting the first power supply member and the second power supply member and freely swinging about a support shaft parallel to a rotational axis of the pressure roller, and a biasing member biasing the support shaft toward the belt, wherein the support shaft is positioned with respect to the support member such that a pressing force applied to the belt by the second power supply member under the bias is greater than a pressing force applied to the belt by the first power supply member under the bias.

5. The fixing device of claim 4, wherein the support member comprises a conductive member and is molded integrally with the first power supply member and the second power supply member.

6. The fixing device of claim 1, wherein each member of the pair of electrodes is a metal film having lower electrical resistance than the resistance heating layer.

7. An image formation device comprising a fixing device including an endless belt with a resistance heating layer, a pressure roller fitting loosely in a circulation path of the belt, and a pressing roller pressing the pressure roller through the belt to form a fixing nip in conjunction with a surface of the belt, and thermally fixing an unfixed image on a recording sheet by passing the recording sheet through the fixing nip, the fixing device comprising:

a pair of annular electrodes provided circumferentially so as to sandwich a sheet-passing region on the surface of the belt therebetween;

a first power supply member pressurizing a given one of the electrodes with pressing force; and a second power supply member positioned closer to the fixing nip than the first power supply member, pressurizing the given one of the electrodes with pressing force, and supplying power to the resistance heating layer in cooperation with the first power supply member, wherein the pressing force applied by the first power supply member is weaker than the pressing force applied by the second power supply member.

* * * * *